US009888712B2

(12) United States Patent
Zimmermann

(10) Patent No.: US 9,888,712 B2
(45) Date of Patent: Feb. 13, 2018

(54) ORAL POUCH PRODUCTS INCLUDING A LINER AND TOBACCO BEADS

(75) Inventor: Stephen G. Zimmermann, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 891 days.

(21) Appl. No.: 12/748,043

(22) Filed: Mar. 26, 2010

(65) Prior Publication Data

US 2010/0300465 A1 Dec. 2, 2010

Related U.S. Application Data

(63) Continuation-in-part of application No. 12/155,635, filed on Jun. 6, 2008.

(60) Provisional application No. 60/929,016, filed on Jun. 8, 2007.

(51) Int. Cl.

| | |
|---|---|
| ***A24B 15/00*** | (2006.01) |
| ***A24B 13/00*** | (2006.01) |
| ***A24D 3/06*** | (2006.01) |
| ***A24B 15/14*** | (2006.01) |

(52) U.S. Cl.

CPC ..... *A24B 13/00* (2013.01); *A24B 15/14* (2013.01); *A24D 3/061* (2013.01)

(58) Field of Classification Search

CPC ..... A24D 3/061; A24B 13/00; A24B 15/14
USPC ..... 131/352
See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |
| 1,376,586 | A | 5/1921 | Schwartz |
| 1,992,152 | A | 2/1935 | Yeates |
| 2,313,696 | A | 3/1941 | Yates |
| 2,306,400 | A | 12/1942 | Menzel |
| 2,318,101 | A | 5/1943 | Rose |
| 2,330,361 | A | 9/1943 | Howard |
| 2,528,778 | A | 11/1950 | Piazze |
| 3,067,068 | A | 12/1962 | Finberg |
| 3,162,199 | A | 12/1964 | Moll, Jr. |
| 3,174,889 | A | 3/1965 | Anderson et al. |

(Continued)

FOREIGN PATENT DOCUMENTS

| | | |
|---|---|---|
| EP | 0212234 A2 | 7/1986 |
| EP | 0145499 | 4/1989 |

(Continued)

OTHER PUBLICATIONS

Michel, Florence, et al. "Preparation and Characterization of Dietary Fiber from Sugar Beet Pulp," Journal of Science and Food Agriculture, 1988, 42, 77-85.*

(Continued)

*Primary Examiner* — Michael H. Wilson
*Assistant Examiner* — Yana B Krinker
(74) *Attorney, Agent, or Firm* — Buchanan Ingersoll & Rooney PC

(57) ABSTRACT

Provided is a pouched, oral tobacco product including a porous membrane having a liner and an inner filling material. The inner filling material includes loose, fibrous tobacco material and tobacco beads formed from tobacco fines and dust which are too small to be included in traditional pouched tobacco products. The tobacco beads are extruded and spheronized.

20 Claims, 1 Drawing Sheet

(56) References Cited

U.S. PATENT DOCUMENTS 3,188,265 A 6/1965 Charbonneau et al.
3,203,432 A 8/1965 Green et al.
3,353,543 A 11/1967 Sproull et al.
3,369,551 A 2/1968 Carroll
3,415,286 A 12/1968 Arnold et al.
3,600,807 A 8/1971 Sipos
3,607,299 A 9/1971 Bolt
3,692,536 A 9/1972 Fant
3,757,798 A 9/1973 Lambert
3,846,569 A 11/1974 Kaplan
3,881,024 A 4/1975 Pahoundis, Sr. et al.
3,932,192 A 1/1976 Nakashio et al.
4,109,663 A 8/1978 Maeda et al.
4,218,286 A 8/1980 Jones et al.
4,240,016 A 12/1980 Inaba et al.
4,341,228 A 7/1982 Keritsis et al.
4,347,855 A 9/1982 Lanzillotti et al.
4,347,857 A 9/1982 Boden
4,355,995 A 10/1982 Berger
4,357,950 A 11/1982 Berger
4,386,106 A 5/1983 Merritt et al.
4,510,950 A 4/1985 Keritsis
4,545,392 A 10/1985 Sensabaugh et al.
4,565,702 A 1/1986 Morley et al.
4,607,479 A 8/1986 Linden
4,624,269 A 11/1986 Story et al.
4,660,577 A 4/1987 Sensabaugh et al.
4,674,519 A 6/1987 Keritsis et al.
4,702,264 A 10/1987 Graves, Jr.
4,703,765 A 11/1987 Paules et al.
4,787,402 A * 11/1988 Leonard ..... 131/370
4,797,287 A 1/1989 Pich et al.
4,821,749 A 4/1989 Toft et al.
4,874,000 A 10/1989 Tamol et al.
4,880,018 A 11/1989 Graves, Jr. et al.
4,880,697 A 11/1989 Caldwell et al.
4,892,483 A 1/1990 Douglas, Jr.
4,893,639 A 1/1990 White
4,906,488 A 3/1990 Pera
4,907,605 A 3/1990 Ray et al.
4,917,161 A 4/1990 Townend
4,924,887 A 5/1990 Raker et al.
4,966,171 A 10/1990 Serrano et al.
4,981,522 A 1/1991 Nichols et al.
4,989,620 A 2/1991 Keritsis et al.
5,007,440 A 4/1991 Robinson et al.
5,099,864 A 3/1992 Young et al.
5,105,836 A 4/1992 Gentry et al.
5,127,208 A 7/1992 Custer et al.
5,148,821 A 9/1992 Best et al.
5,167,244 A 12/1992 Kjerstad
5,174,088 A 12/1992 Focke et al.
5,186,185 A 2/1993 Mashiko et al.
5,211,985 A 5/1993 Shirley, Jr. et al.
5,240,016 A 8/1993 Nichols et al.
5,263,999 A 11/1993 Baldwin et al.
5,339,838 A 8/1994 Young et al.
5,346,734 A 9/1994 Wydick, Jr.
5,372,149 A 12/1994 Roth et al.
5,387,416 A 2/1995 White et al.
5,501,237 A 3/1996 Young et al.
5,525,351 A 6/1996 Dam
5,549,906 A 8/1996 Santus
5,598,868 A 2/1997 Jakob et al.
5,601,716 A 2/1997 Heinrich et al.
5,724,998 A 3/1998 Gellatly et al.
5,725,886 A 3/1998 Erkoboni et al.
5,726,161 A 3/1998 Whistler
5,763,083 A 6/1998 Berrigan
5,773,062 A 6/1998 Cirigliano et al.
5,806,408 A 9/1998 DeBacker et al.
5,829,453 A 11/1998 White et al.
5,845,648 A 12/1998 Martin
5,921,955 A 7/1999 Mazer et al.
5,927,052 A 7/1999 Nippes et al.
5,997,691 A 12/1999 Gautam et al.
6,021,624 A 2/2000 Richison et al.
6,026,820 A 2/2000 Baggett, Jr. et al.
6,135,120 A 10/2000 Löfman et al.
6,143,316 A 11/2000 Hayden et al.
6,146,655 A 11/2000 Ruben
6,162,516 A 12/2000 Derr
6,280,761 B1 8/2001 Santus
6,287,612 B1 9/2001 Mandava et al.
6,325,859 B1 12/2001 De Roos et al.
6,383,475 B1 5/2002 Meyers et al.
6,414,033 B1 7/2002 Sceusa
6,444,253 B1 9/2002 Conklin et al.
6,455,068 B1 9/2002 Licari
D489,606 S 5/2004 Lofman
6,840,248 B2 1/2005 Zielke
6,871,473 B1 3/2005 Dutt et al.
6,878,695 B2 4/2005 Woo et al.
6,880,018 B1 4/2005 Kajiki et al.
6,895,974 B2 5/2005 Peele
6,942,848 B2 9/2005 Nelson et al.
6,958,429 B2 10/2005 Bruhn et al.
6,982,093 B2 1/2006 Licari
6,984,376 B2 1/2006 Stephenson et al.
7,030,092 B1 4/2006 Levine
7,032,601 B2 4/2006 Atchley et al.
7,090,858 B2 8/2006 Jayaraman
7,186,701 B2 3/2007 Kubota et al.
D568,576 S 5/2008 Neidle et al.
D585,626 S 2/2009 Chappell, Sr. et al.
7,584,843 B2 9/2009 Kutsch et al.
2002/0012689 A1 1/2002 Stillman
2002/0162563 A1* 11/2002 Williams ..... 131/352
2002/0166563 A1 11/2002 Jupe et al.
2002/0170567 A1* 11/2002 Rizzotto et al. ..... 131/359
2003/0070687 A1 4/2003 Atchley et al.
2003/0109492 A1 6/2003 Loftsson
2003/0224090 A1 12/2003 Pearce et al.
2004/0015756 A1 1/2004 Chiu
2004/0018293 A1 1/2004 Popplewell et al.
2004/0037879 A1 2/2004 Adusumilli et al.
2004/0081691 A1 4/2004 Debregeas et al.
2004/0118421 A1 6/2004 Hodin et al.
2004/0123873 A1 7/2004 Calandro et al.
2004/0145261 A1 7/2004 Ganter et al.
2004/0191322 A1 9/2004 Hansson
2004/0191366 A1 9/2004 Mangos et al.
2004/0202698 A1 10/2004 Ramji et al.
2004/0234479 A1 11/2004 Schleifenbaum et al.
2004/0247649 A1 12/2004 Pearce et al.
2004/0247744 A1 12/2004 Pearce et al.
2004/0247746 A1 12/2004 Pearce et al.
2005/0000531 A1 1/2005 Shi
2005/0003048 A1 1/2005 Pearce et al.
2005/0034738 A1 2/2005 Whalen
2005/0061339 A1 3/2005 Hansson et al.
2005/0081264 A1 4/2005 Brugliera et al.
2005/0098187 A1 5/2005 Grierson et al.
2005/0100640 A1 5/2005 Pearce
2005/0172976 A1 8/2005 Newman et al.
2005/0178398 A1 8/2005 Breslin et al.
2005/0210615 A1 9/2005 Shastry et al.
2005/0241656 A1 11/2005 Kennison
2005/0244521 A1 11/2005 Strickland et al.
2005/0287249 A1 12/2005 Shukla et al.
2006/0039973 A1 2/2006 Aldritt et al.
2006/0073190 A1 4/2006 Carroll et al.
2006/0118589 A1 6/2006 Arnarp et al.
2006/0144412 A1 7/2006 Mishra et al.
2006/0174901 A1 8/2006 Karles et al.
2006/0191548 A1 8/2006 Strickland et al.
2006/0204598 A1 9/2006 Thompson
2006/0228431 A1 10/2006 Eben et al.
2006/0272662 A1 12/2006 Jupe et al.
2006/0275344 A1 12/2006 Mody et al.
2007/0000505 A1* 1/2007 Zhuang et al. ..... 131/342
2007/0012328 A1* 1/2007 Winterson et al. ..... 131/347
2007/0048431 A1 3/2007 Budwig et al.
2007/0062549 A1 3/2007 Holton, Jr. et al.

(56) References Cited

U.S. PATENT DOCUMENTS

| | | | | |
|---|---|---|---|---|
| 2007/0077307 | A1 | 4/2007 | Rosenberg et al. | |
| 2007/0084476 | A1 | 4/2007 | Szu-Sung et al. | |
| 2007/0095356 | A1 | 5/2007 | Winterson et al. | |
| 2007/0107747 | A1 | 5/2007 | Hill et al. | |
| 2007/0122526 | A1 | 5/2007 | Sweeney et al. | |
| 2007/0186941 | A1 | 8/2007 | Holton, Jr. et al. | |
| 2007/0186942 | A1 | 8/2007 | Strickland et al. | |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2007/0207239 | A1 | 9/2007 | Neidle et al. | |
| 2007/0261707 | A1 | 11/2007 | Winterson et al. | |
| 2007/0267033 | A1 | 11/2007 | Mishra et al. | |
| 2007/0298061 | A1 | 12/2007 | Boghani et al. | |
| 2008/0014303 | A1 | 1/2008 | Jacops et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0138489 | A1 | 6/2008 | Nagao et al. | |
| 2008/0166395 | A1 | 7/2008 | Roush | |
| 2008/0173317 | A1 | 7/2008 | Robinson et al. | |
| 2008/0196730 | A1 | 8/2008 | Engstrom et al. | |
| 2008/0202536 | A1* | 8/2008 | Torrence et al. | 131/275 |
| 2008/0302682 | A1 | 12/2008 | Engstrom et al. | |
| 2008/0308115 | A1 | 12/2008 | Zimmerman et al. | |
| 2008/0317911 | A1 | 12/2008 | Schleef et al. | |
| 2009/0004329 | A1 | 1/2009 | Gedevanishvili et al. | |
| 2009/0022856 | A1 | 1/2009 | Cheng et al. | |
| 2009/0022917 | A1 | 1/2009 | Gedevanishvili et al. | |
| 2009/0025740 | A1 | 1/2009 | Chappell, Sr. et al. | |
| 2009/0025741 | A1 | 1/2009 | Crawford et al. | |
| 2009/0035414 | A1 | 2/2009 | Cheng et al. | |
| 2009/0126746 | A1 | 5/2009 | Strickland et al. | |
| 2010/0218779 | A1 | 9/2010 | Zhuang et al. | |
| 2010/0300464 | A1 | 12/2010 | Gee et al. | |

FOREIGN PATENT DOCUMENTS

| | | | | |
|---|---|---|---|---|
| EP | 0352107 | A2 | 1/1990 | |
| EP | 0483500 | A1 | 5/1992 | |
| EP | 0 422 898 | | 9/1994 | |
| EP | 0 599 425 | | 10/1997 | |
| EP | 1010639 | A1 | 6/2000 | |
| EP | 1118274 | A | 7/2001 | |
| GB | 725764 | | 3/1955 | |
| GB | 924052 | | 4/1963 | |
| GB | 1139684 | | 1/1969 | |
| GB | 1350740 | | 4/1974 | |
| GB | 2074838 | A | 11/1981 | |
| JP | 03-240665 | | 10/1991 | |
| WO | WO 94/25356 | | 11/1994 | |
| WO | WO 97/45336 | | 12/1997 | |
| WO | WO 99/40799 | | 8/1999 | |
| WO | WO 00/57713 | | 10/2000 | |
| WO | WO 01/70591 | A1 | 9/2001 | |
| WO | WO 02/080707 | A1 | 10/2002 | |
| WO | WO 03/028492 | A1 | 4/2003 | |
| WO | WO 03/030881 | | 4/2003 | |
| WO | WO 03/053175 | A2 | 7/2003 | |
| WO | WO 2004/009445 | | 1/2004 | |
| WO | WO 2004/052335 | | 6/2004 | |
| WO | WO 2004/056219 | | 7/2004 | |
| WO | WO 2004/058217 | | 7/2004 | |
| WO | WO 2004/064811 | A1 | 8/2004 | |
| WO | WO 2004/066986 | | 8/2004 | |
| WO | WO 2004/095959 | A1 | 11/2004 | |
| WO | WO 2005/027815 | | 3/2005 | |
| WO | WO2005/046363 | A | 5/2005 | |
| WO | WO 2005/077232 | | 8/2005 | |
| WO | WO 2005/084446 | | 9/2005 | |
| WO | WO 2006/004480 | | 1/2006 | |
| WO | WO 2006/039487 | A | 4/2006 | |
| WO | WO 2006/065192 | | 6/2006 | |
| WO | WO2006/090290 | A | 8/2006 | |
| WO | WO 2006090290 | * | 8/2006 | A24D 3/16 |
| WO | WO 2006/105173 | | 10/2006 | |
| WO | WO 2006/120570 | A2 | 11/2006 | |
| WO | WO 2006/127772 | A | 11/2006 | |
| WO | WO 2007/037962 | * | 4/2007 | A24B 13/00 |
| WO | WO2007/037962 | A | 4/2007 | |
| WO | WO 2007/057789 | A2 | 5/2007 | |
| WO | WO 2007/057791 | A2 | 5/2007 | |
| WO | WO 2007/082599 | A1 | 7/2007 | |
| WO | WO 2007/104573 | | 9/2007 | |
| WO | WO 2007/126361 | A1 | 11/2007 | |
| WO | WO 2008/016520 | A2 | 2/2008 | |
| WO | WO 2008/042331 | A2 | 4/2008 | |
| WO | WO 2008/104891 | A2 | 9/2008 | |
| WO | WO 2008/140372 | A1 | 11/2008 | |

OTHER PUBLICATIONS

U.S. Appl. No. 12/642,399, filed Dec. 18, 2009.

Satel, Sally M.D., "A Smokeless Alternative to Quitting," Apr. 6, 2004, The New York Times, Accessed Oct. 25, 2010; http://query.nytimes.com/gst/fullpage.html?res=9402EFD91E39F935A35757C0A9629C8B63.

Chris Vervaet et al., Extrusion-Spheronisation a Literature Review, International Journal of Pharmaceutics, 116 (1995), pp. 131-146.

John C. Leffingwell et al., Tobacco Flavoring for Smoking Products, R. J. Reynolds Tobacco Company, 1972, cover page and table of contents.

F. El Saleh et al., Influence of Cellulose Type on the Properties of Extruded Pellets, S.T.P. Pharma Sciences 10, (5), 2000, pp. 379-385.

Otilia May Yue Koo et al., The Influence of Microcrystalline Cellulose Grade on Shape and Shape Distributions of Pellets Produced by Extrusion-Spheronization, Chem. Pharm. Bull. 49 (11) 2001, pp. 1383-1387.

Petra M. Fecher et al., Properties of Microcrystalline Cellulose and Powder Cellulose After Extrusion/Spheronization as Studied by Fourier Transform Raman Spectroscopy and Environmental Scanning Electron Microscopy, AAPS PharmSci. 2003; 5 (4), Article 31, pp. 1-13.

International Preliminary Report on Patentability dated Aug. 28, 2007 for PCT/IB2006/001114.

International Search Report and Written Opinion dated Jul. 25, 2006 for PCT/IB2006/001114.

International Search Report and Written Opinion dated Feb. 25, 2009 for PCT/IB2008/002566.

Partial International Search Report dated Oct. 6, 2006 for PCT/IB2006/001611.

International Search Report and Written Opinion dated Feb. 27, 2007 for PCT/IB2006/002680.

International Preliminary Report on Patentability dated Oct. 30, 2007 for PCT/IB2006/001611.

International Preliminary Report on Patentability dated Dec. 16, 2008 for PCT/IB2006/002680.

International Search Report and Written Opinion dated Aug. 6, 2007 for PCT/IB2006/004077.

International Search Report and Written Opinion dated Sep. 12, 2008 for PCT/IB2008/001378.

International Search Report and Written Opinion dated Mar. 24, 2009 for PCT/IB2008/002764.

International Preliminary Report on Patentability dated Jan. 19, 2010 for PCT/IB2008/002764.

International Search Report and Written Opinion dated Jul. 17, 2009 for PCT/IB2008/002714.

International Preliminary Report on Patentability dated Jan. 19, 2010 for PCT/IB2008/002714.

International Search Report and Written Opinion dated Jan. 30, 2009 for PCT/IB2008/002598.

International Preliminary Report on Patentability dated Dec. 11, 2009 for PCT/IB2008/002598.

International Search Report and Written Opinion dated Mar. 25, 2009 for PCT/IB2008/002682.

International Preliminary Report on Patentability dated Jan. 19, 2010 for PCT/IB2008/002682.

(56) References Cited

OTHER PUBLICATIONS

International Search Report and Written Opinion dated Mar. 31, 2009 for PCT/IB2008/002681.
U.S. Appl. No. 12/805,868, filed Aug. 20, 2010.
U.S. Appl. No. 12/789,125, filed May 27, 2010.
U.S. Appl. No. 12/748,205, filed Mar. 26, 2010.
International Search Report and Written Opinion dated Mar. 13, 2009 for PCT/IB2008/002694.
International Preliminary Report on Patentability dated Jan. 19, 2010 for PCT/IB2008/002694.

* cited by examiner

ORAL POUCH PRODUCTS INCLUDING A LINER AND TOBACCO BEADS

CROSS REFERENCE TO RELATED APPLICATION

This application is a continuation-in-part of U.S. Utility application Ser. No. 12/155,635, entitled "ORAL POUCHED PRODUCTS INCLUDING AGGLOMERATED FINES" and filed on Jun. 6, 2008, which claims priority to U.S. Provisional Application. No. 60/929,016, filed Jun. 8, 2007, the entire contents of both of which are hereby incorporated by reference

SUMMARY

Provided is a pouched, oral tobacco product comprising a porous membrane comprising a liner and an inner filling material. The inner filling material comprises extruded and spheronized tobacco beads in an amount of about 10% to about 95% by weight based on the weight of the pouched, oral tobacco product and loose, fibrous tobacco material. The extruded and spheronized tobacco beads comprise an agglomeration of tobacco fines and a quantity of water. The extruded and spheronized tobacco beads have a moisture content of about 0.5% to about 25% and the inner filling material is enclosed within a pouch formed by the porous membrane including the liner.

Also provided is a method of making a pouched, oral tobacco product. The method comprises spheronizing and/or extruding a plurality of tobacco beads, mixing the plurality of tobacco beads with loose, fibrous tobacco material to form an inner filling material, forming a pouch from a porous membrane material, adding a dissolvable liner to the pouch to form a lined pouch, placing the inner filling material in the lined pouch, and sealing the lined pouch to form a pouched, oral tobacco product.

DETAILED DESCRIPTION

Provided is an oral tobacco product including tobacco beads. The oral tobacco product is a pouched tobacco product as described in U.S. patent application Ser. No. 12/155,635, filed on Jun. 6, 2008, the entire content of which is incorporated herein by reference.

In a preferred embodiment, the pouched tobacco product is sized and configured to fit comfortably in a user's mouth. Preferably, the pouched tobacco product has dimensions of less than about 2 inches.

Figure 1A:
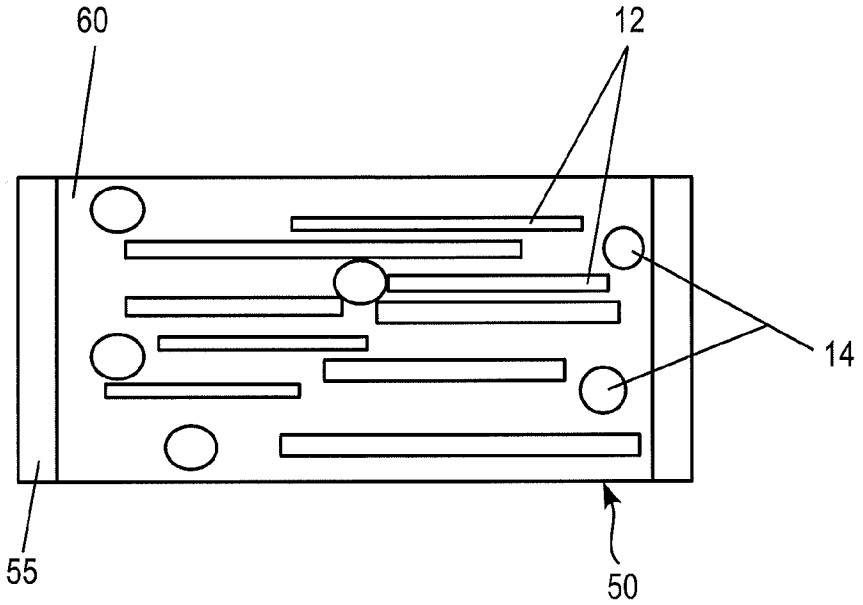
FIG. 1A is an illustration of a pouched, oral tobacco product including tobacco beads.

As illustrated in FIG. 1A, a pouched, oral tobacco product 50 includes an inner filling material. The inner filling material 11 includes a portion of a loose, fibrous tobacco material 12 and tobacco beads 14 enclosed in a porous membrane 60. In the preferred embodiment, the tobacco beads 14 are dispersed throughout the loose, fibrous tobacco material 12 to form the inner filling material 11 that is enclosed within the porous membrane 60 that forms the pouch.

Preferably, the tobacco beads are included in the pouched, oral tobacco product 50 in an amount of about 10% to about 95% (e.g., about 10% to about 20%, about 20% to about 30%, about 30% to about 40%, about 40% to about 50%, about 50% to about 60%, about 60% to about 70%, about 70% to about 80% or about 80% to about 95%).

In a preferred embodiment, the porous membrane 60 is a porous, polymeric, organic, and/or food grade material. The porous membrane 60 may be a web of cellulose fiber of the sort used to form tea-bags. An adhesive may be placed on a die of the pouch material 60 so that seams 55 can be formed when the pouch is constructed.

In a preferred embodiment, the porous membrane 60 maintains sufficient structural integrity during the time period that the pouch product 50 is used so that the inner filling material 11 is retained therein. In another embodiment, the porous membrane 60 may be dissolvable or disintegrable and composed of soluble polymers. When the porous membrane 60 is dissolvable or disintegrable, the porous membrane 60 can be heat sealed or a polymer adhesive can be used to form seams 55 that seal the pouch product 50. In an embodiment, flavorants may be added to an outside surface of the porous membrane 60 to provide additional flavor to the user.

The pouch product 50 may be sized and configured for comfortable placement in a user's mouth between the cheek and gum. The pouch product 50 may have a square, rectangle, circular, moon, crescent, or oblong shape. Preferably, sharp corners are avoided as sharp corners may lead to oral discomfort. The porous membrane 60 includes seams 55 around the edges to contain the inner filling material 11 within the porous membrane 60. Alternatively, the pouch product 50 can include one longitudinal seam 57 and two transverse seams 59 (shown in FIG. 1B). In another embodiment, the porous membrane 60 can be folded and sealed on three sides.

Preferably, the pores in the porous membrane 60 allow flavors to diffuse through the material and into the user's mouth.

Figure 1B:
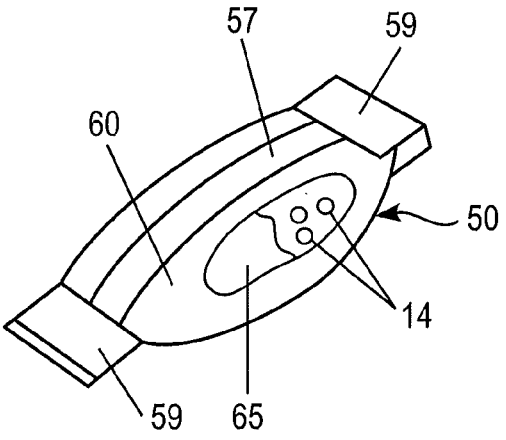
FIG. 1B is a perspective view of an alternate pouched, oral tobacco product with a partial cutaway showing a liner.

Referring now to FIG. 1B, in another preferred embodiment, the pouched, oral tobacco product 50 includes a porous membrane 60 having an inner liner 65 as described in commonly-assigned United States Patent Publication 2007/0012328, the disclosure of which is hereby incorporated by reference herein in its entirety. Preferably, the porous membrane 60 and/or liner 65 enclose an inner filling material 11 including loose, fibrous tobacco material 12 and tobacco beads 14.

As used herein the terms "liner" and "liner material" include one or more material sheets, layers or coatings, which can be used to carry flavorants (flavor enhancers) and/or reduce transfer of moisture from the inner filling material 11 to the porous membrane 60, and/or reduce staining of the porous membrane 60.

In a preferred embodiment, a liner 65 is incorporated as a separate sheet, layer or coating on the inside of the porous membrane 60 facing the inner filling material 11. As such, the liner 65 can be a thin film sheet, layer or coating of only a few microns in thickness or can be a thicker sheet, layer or coating up to about 0.5 centimeters in thickness.

In an embodiment, the liner 65 dissolves upon placement of the pouched tobacco product into the mouth. In other embodiments the liner 65 only partially dissolves or does not dissolve in the oral cavity. If the liner 65 does not dissolve, the liner 65 is porous so that the flavors from the inner filling material can leach out through the liner 65 and the pouch material 60.

Preferably, the liner 65 is not soluble in tobacco additives of the inner filling material 12 so that the additives may be added to the inner filling material without causing the liner 65 to be dissolved. By such arrangement the effectiveness of the liner 65 against staining of the web is maintained.

The liner 65 can also be made semi water-soluble in order to provide a slower rate of dissolution of the liner 65 when placed in a mouth, if desired. For example, the liner 65 itself can be used to augment or be the carrier of a flavorant or flavor enhancer, wherein the liner 65 can provide rapid flavor release (i.e., high water solubility) or a time sustained flavor release (i.e., low water solubility compared to the rapid flavor release liner). The liner 65 can also include both highly soluble flavor ingredients and less soluble flavor ingredients. Thus, by using a liner 65 with predetermined level water solubility, a pouched tobacco product can be provided with rapid or time sustained flavor release and minimum staining of the web.

While the liner 65 can be used in an unflavored state, a flavorant can be incorporated in the liner 65, as mentioned above. When a flavorant is incorporated into the liner 65, the liner 65 can be chosen to provide rapid flavor release and/or provide a long lasting, time-release flavor.

While any water-soluble material, such as cellulosic materials, gums, polymers, starches, proteins, and combinations thereof can be used, preferably the liner 65 is made of glucans because of their high water solubility and rapid dissolution. Other exemplary liners 65 include food grade materials, such as polysaccharides including pullulan, protein films, porous papers and fabrics and/or synthetic polymers, including those listed above. It is noted, however, that any liner that is biocompatible and reduces staining of the web can be used. Films that can be used for the liner include films manufactured by MonoSol, LLC of Portage, Ind. as set forth in International Publication Numbers WO 2004/009445 and WO 2004/052335, hereby incorporated by reference in their entireties.

The liner 65 can be disposed along the porous membrane 60 by any suitable technique. For example, a strip of liner material can be fed along with a strip of porous membrane 60 and the strips can optionally be engaged with each other by pressing the strips together, use of adhesive or tackiness of the liner material. Alternatively the liner material can be coated on the porous membrane 60. In the case of multiple coatings, each coating, which may be the same or different liner, of a multilayered liner is preferably dried before application of subsequent coatings.

In an embodiment, the liner 65 is coated onto the porous membrane 60 prior to assembly of the pouched tobacco product 50 by a suitable coating process, such as, for example, kiss coating, slot coating, spraying or gravure printing. Coating of the liner 65 on the porous membrane 60 allows for enhanced control and maintenance of the desired level of translucency of the liner. Alternatively, the color of the pouched tobacco product may be controlled by inclusion of appropriate color additives into the liner 65 such as whiteners or the like. Thus, through appropriate selection of additives for the liner 65, the opaqueness, whiteness, and/or color of the pouched tobacco product may be controlled.

As used herein, the terms "tobacco bead" and "tobacco beads" refer to extruded and/or spheronized beads constructed as described herein and including at least an agglomeration of tobacco fines and water. In an embodiment, the tobacco fines are small tobacco particles that are too small for inclusion in tobacco products. The tobacco fines are preferably sieved with mesh size less than about 60 to provide tobacco fines having a maximum particle size of about 0.5 mm. More preferably, the tobacco fines may be chosen within the range of about 60 mesh to about 400 mesh or higher mesh values. The tobacco fines are combined to form beads, which are of a size suitable for inclusion in tobacco products. The tobacco beads can also include flavorants and/or binders.

Ground tobacco for inclusion in snus typically ranges from about 20 mesh to about 60 mesh. Particles of less than about 60 mesh tend to go airborne during pouching operations, thereby wasting tobacco and creating cleanliness issues during pouching operations. Thus, tobacco particles below 60 mesh are preferably separated out prior to pouching. These particles, which would otherwise be waste, can be formed into tobacco beads using the processes described herein.

All mesh values are reported herein as United States standard sieve and those values reflect the ability of more than 95% of the particles of a given size to pass through a screen of a given mesh value. In that connection, mesh values reflect the number of mesh holes for each inch of screen.

Preferably, the tobacco beads 14 are made of an agglomeration of tobacco fines and water. In one embodiment, the tobacco beads 14 may also include flavorants 16. In a preferred embodiment, the tobacco beads 14 include a binder 18. In another embodiment, the tobacco beads 14 do not include a binder.

For tobacco beads, which include a binder additive, preferably, about 5 wt % to about 90 wt % of the tobacco bead is tobacco particles, and more preferably from about 30 weight % to about 65 weight % of the tobacco bead is tobacco particles.

For tobacco beads, which do not include a binder additive, preferably about 50 wt % to 100 wt % of the tobacco beads is tobacco particles, more preferably 90 wt % to 100 wt % of the tobacco beads is tobacco particles.

The tobacco beads 14 can be prepared using known extrusion and spheronization processes for producing pharmaceutical pellets and flavored beads, such as the techniques described in commonly owned U.S. Patent Application Publication No. 2007/0000505, filed on Feb. 22, 2006, the entire content of which is incorporated herein by reference.

For tobacco beads 14 including tobacco particles, water and optional flavorants, but not including added binder ingredients, one method of making the beads 14 includes mixing tobacco fines with water to form a uniform wet mass and adding optional flavorants. The wet mass is then forced through an extruder to form strands of extrudate. The extrudate is broken into short strands and spheronized to form wet spheres. The tobacco beads can be spheronized from the extrudate by using an LCI QJ-230T Marumerizer at a suitable rotation speed (e.g., 1200 RPM) for a suitable time (e.g., 10 minutes). Preferably, the beads are then dried to remove a portion of the liquid. Additionally flavorants and/or coatings can be added to the beads after drying.

In an embodiment, the tobacco beads contain binder ingredients. The mixing step includes mixing the tobacco particles with a dry and/or liquid binder, water and optional flavorants to form a wet mass. The wet mass is then extruded and the extrudate spheronized.

The resulting tobacco beads are preferably in the form of spheroids that are substantially round or oval in shape. Further, each spheroidal tobacco bead can have a diameter of about 0.1 mm to about 2.5 mm, preferably about 0.2 mm to about 1.2 mm, and more preferably about 0.3 mm to about 0.7 mm.

When a binder is not used, the ratio of the amount of the tobacco particles and water can be about 1:4 to about 4:1, preferably about 2:1.

In an embodiment, a first moisture content of the spheronized beads, prior to drying, is preferably about 20 to 40% of a total weight of the moist tobacco beads. A moisture content of the dried tobacco beads is about 0.5% to about 25% of a total weight of the tobacco beads, and more preferably about 8% to about 25% (e.g., about 8% to about 10%, about 10% to about 15%, about 15% to about 20%, or about 20% to about 25%) of a total weight of the dried tobacco beads.

In an embodiment, the binder 18 is a cellulosic material and/or a fiber based material. A preferred cellulosic material is microcrystalline cellulose (MCC). A preferred fiber based material is sugar beet fibers such as Fibrex®. Additional dry and liquid binders 18 may be present in the beads 14 as well as additional flavorants 16 and fillers. In another embodiment, the binder may be a suitable dry binder, an extrusion and spheronization aiding composition and reagent, a water swellable polymer, polymer binders, or mixtures of thereof.

Preferably, the materials of extrusion and spheronization aiding reagents are those which are capable of holding liquid like a sponge. These reagents also further restrict the separation of the liquid from the solid that can occur during extrusion and spheronization processes. The extrusion and spheronization aiding reagents include but are not limited to microcrystalline cellulose (MCC), pectinic acid, lactose, and glyceryl monostearate, and combinations thereof.

Suitable water-swellable polymers include, without limitation, hydroxypropyl methylcellulose (HPMC), low substituted hydroxypropyl cellulose (L-HPC), and hydroxypropyl cellulose (HPC).

Suitable polymer binders include, without limitation, polyvinyl pyrolidone (PVP), EUDRAGIT®, and cellulose ethers.

Figure 2:
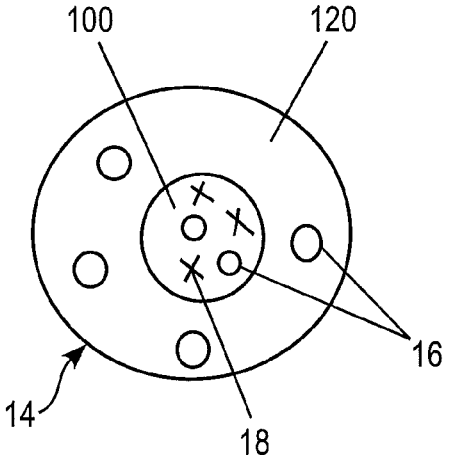
FIG. 2 is an illustration of a cross-sectional view of a tobacco bead including a coating.

In another embodiment, as seen in FIG. 2, the tobacco beads 14 include one or more coatings 120 over the agglomerated fines 100. Preferably, flavorants 16 can also be added to the coatings 120 of the beads 14. Such coatings are not necessary to hold the tobacco beads together, but can be added to provide additional textures and/or flavorants.

In a preferred embodiment, the flavorants are added to the tobacco beads 14 during manufacture. Alternatively, the flavorants may be added to the beads after formation. The optional flavorant includes flavor materials that are practically unlimited, although water-soluble, alcohol-soluble and oil-soluble flavors are preferable.

Suitable flavorants include, without limitation, lavender, cinnamon, cardamom, *apium graveolens*, fenugreek, cascarilla, sandalwood, bergamot, geranium, honey essence, rose oil, vanilla, lemon oil, orange oil, mint oils, *cassia*, caraway, cognac, jasmine, chamomile, menthol, *cassia*, ylang-ylang, sage, spearmint, ginger, coriander, and coffee. Each of the flavors can be used singly or mixed with others. If desired, diluent agents can be added to the tobacco beads. Diluent agents which can be used for this purpose include powdered starch, such as but not limited to corn starch and potato starch, rice powder, calcium carbonate, diatomaceous earth, talc, acetate powder, and pulp flock. The optional flavorant can also be in the form of a solid matrix (liquid flavorants spray dried with a starch). The optional flavorant can also be in the form of solids, liquids or gels. The optional flavorant can be present in the tobacco beads in an amount of up to 50% by weight (e.g., 0.1 to 5%, 5 to 10%, 10 to 15%, 15 to 20%, 20 to 25%, 25 to 30%, 30 to 35%, 35 to 40%, 40 to 45% or 45 to 50%).

In one embodiment, the tobacco beads can be tailored to have controlled-delivery release of active compounds. For example, diffusion of the flavors from the beads can be adjusted by bead porosity and density as well as by any controlled-release coating added to the beads. In an embodiment, the beads can also be coated with polymeric coatings of different functionalities and or compositions (e.g., single or multiple overcoats depending on the application) to control the delivery and release of the active compounds.

Preferred active compounds include, without limitation, vitamins, minerals, nutraceuticals, energizing agents, soothing agents, sweeteners, coloring agents, amino acids, antioxidants, preservatives and/or combinations thereof.

In another embodiment, the tobacco beads can act as a delivery system for delivering flavors naturally occurring in the components of the bead formulation. Alternatively, the tobacco beads can act as a medium for creating and/or enhancing naturally occurring flavors through Mailard, enzymatic, or other types of reactions.

In another embodiment, the beads 14 can be altered or enhanced by thermal treatment of the beads 14 after formation. For example, the beads can be treated by heating at a temperature from about 40° C. to about 300° C. for a period of about 5 minutes to several hours.

In one embodiment, the tobacco fines can be gathered from dust and fines that are too small for inclusion directly into a tobacco pouch product. Alternatively, the tobacco dust and fines can be formed by taking parts of the tobacco plant (leaf, stem, and the like) and grinding the dried portions into a fine powder or dust. The tobacco plant can be green or cured.

The tobacco parts used to make the tobacco particles can be from any type of tobacco used to prepare oral tobacco products such as but not limited to Burley, Bright, Oriental, or blends thereof, as well as genetically altered, chemically altered, or mechanically altered tobacco plants and blends thereof. The type of tobacco is preferably selected from the group consisting of Burley, Bright, and Oriental. The blend of ground tobacco particles can include up to 5%, 10%, 15%, 20%, 25%, 30%, 35%, 40%, 45%, 50%, 55%, 60%, 65%, 70%, 75%, 80%, 85%, 90%, 95%, or 100% by weight of Burley; up to 5%, 10%, 15%, 20%, 25%, 30%, 35%, 40%, 45%, 50%, 55%, 60%, 65%, 70%, 75%, 80%, 85%, 90%, 95%, or 100% by weight of Bright; and/or up to 5%, 10%, 15%, 20%, 25%, 30%, 35%, 40%, 45%, 50%, 55%, 60%, 65%, 70%, 75%, 80%, 85%, 90%, 95%, or 100% by weight of Oriental.

The blend of the tobacco fines used, the formulation of the optional dry or liquid binder, the concentration of liquid in the tobacco beads, and the size of the tobacco beads are all elements which can be altered alone or in combination with each other to achieve a desired taste.

In an embodiment, the quantity and the blend of the optional powdered binder used can be selected so as to achieve the desired mechanical strength and roundness of the resulting tobacco beads. The strength and roundness of the beads depends in part on the starting materials. For example, the tobacco beads can optionally comprise a cellulosic and/or fiber based binder material as well as the tobacco particles.

The tobacco fines preferably have an average particle size suitable for forming a wet tobacco mixture which can be formed into tobacco beads. The tobacco is preferably sieved with mesh size less than about 60 to provide tobacco fines with a maximum particle size of about 0.5 mm.

The drying of the tobacco beads consisting essentially of tobacco particles can be carried out under vacuum to the second moisture content of about 0.5% to about 25% of a total weight of the tobacco beads). As an alternative, the drying of the tobacco beads can be carried out in other drying equipment such as a conventional fluidized bed dryer, in a conventional oven dryer, or in a vacuum oven.

Not wishing to be bound by theory, it is believed that vacuum drying minimizes loss of organic compounds providing desired organoleptic properties and promotes migration of flavor compounds to the surface of the tobacco beads. Accordingly, a preferred tobacco bead comprises tobacco particles in a condition of having been vacuum dried to a predetermined moisture content of about 0.5 to 25% by weight, and more preferably about 8% to about 25%.

For tobacco particles containing additive binder such as a non-tobacco cellulosic material, microcrystalline cellulose (MCC) is a preferred cellulosic material in combination with tobacco particles. Another preferred binder is a fiber-based material such as sugar beet fibers.

The optional flavor additives for the tobacco beads can be incorporated for example using a solvent mixture. Using a solvent mixture, it is possible to incorporate the optional flavor constituents into the cellulosic or fiber-based binder containing tobacco beads in minute amounts, on the order of parts per million.

In an embodiment, other binder materials which can be used include carboxymethyl cellulose (CMC), and more amorphous forms of cellulose (e.g., powdered cellulose) as well as combinations of crystalline, and modified cellulose (e.g., hydroxypropyl cellulose and hydroxypropyl methylcellulose), and amorphous cellulose. Other natural polysaccharides and their derivatives are also contemplated for use in the tobacco beads.

The wet mass can be prepared in a mixer such as a planetary mixer. The extrusion can be carried out using extruders such as the screw, sieve and basket, roll and ram type extruders. Spheronization can be carried out using a spinning friction plate that effects rounding of extrudate particles. Water is preferably used to provide the wet mass with desired rheological characteristics. For example, the water content can be adjusted to achieve the desired plasticity, e.g., the water content may range from 20% to 150% (preferably 40 to 60%) by weight or at least about in a proportion of one-to-four to four-to-one of liquid to dry material. With use of liquid flavorants, the liquid content of the wet mass is preferably adjusted to account for the effect of the liquid flavorant on the rheological characteristics of the wet mass.

The wet mass is extruded through suitably sized pierced screens and spheronized using a rotating disk having a grooved surface. The spheres are then dried in a fluidized bed or conventional convection oven or vacuum oven to a moisture level of about 0.5% to about 25%, and more preferably about 8% to about 25%.

For tobacco beads containing a dry binder additive, it should be noted that the weight percent of dry binder and weight percent of tobacco particles appear to have conflicting effects: an increase in tobacco content increases the impact on the taste but decreases the mechanical properties (i.e., hardness, attrition resistance) of the tobacco beads. On the other hand, an increase in the dry binder (e.g., MCC or sugar beet fibers) appears to decrease the impact on the taste but increases the mechanical strength. The mechanical strength and uniformity in size distribution are also affected by the liquid content in the wet mass, size of the opening on the extrusion die, and processing parameters such as extrusion speed, rotation speed, and duration of spheronization. For a given blend of tobacco particles, the optimal formulation and processing conditions are empirically determined.

The beaded form of the tobacco agglomerates facilitates high-speed pouch filling operations during the manufacture of pouched products. Beads tend to more consistently and cleanly flow into and out of metering feed machinery, with less scatter and dusting than loose, irregular tobacco particles.

As taught hereinabove, provided is a method of improving utilization of tobacco feed stock in a process of making an oral pouched tobacco product or the like that requires grinding the tobacco feedstock to a desired range of tobacco particle size for the product, for example, to a desired range of approximately 20 to approximately 60 mesh (more preferably 20 mesh to 40 mesh). Tobacco utilization is improved by separating the tobacco particles of finer size (finer than 60 mesh or finer than 40 mesh) from those of the desired range of particle size (i.e., larger than 60 mesh or larger than 40 mesh), forming the finer-sized tobacco into agglomerated tobacco fines as taught hereinabove, and recombining the agglomerates and the tobacco particles in the oral pouched tobacco products. By such practices, the tobacco fines may be utilized instead of being discarded, and the difficulties associated with tobacco fines, such as their tendency to escape from pouches during feeding operations or otherwise causing dusting, impact on product appearance and/or impact on cleanliness during manufacturing operations, are abated.

In an embodiment, the inner filling material of the oral pouch product can also includes loose, fibrous tobacco material. As used herein, the term "loose, fibrous tobacco material" describes tobacco fibers, shreds and the like, commonly used in smokeless tobacco products, and having a size of greater than about 400 mesh.

Examples of suitable types of tobacco materials that can be used in the oral tobacco product include, but are not limited to, flue-cured tobacco, air-cured, Burley tobacco, Maryland tobacco, Oriental tobacco, rare tobacco, specialty tobacco, blends thereof and the like. The loose, fibrous tobacco material may be provided in any suitable form, including, but not limited to, tobacco lamina, processed tobacco materials such as volume expanded or puffed tobacco, aged tobacco, processed tobacco stems, such as cut-rolled or cut-puffed stems, reconstituted tobacco materials, blends thereof, and the like. The tobacco may also be genetically modified tobacco or tobacco having a reduced tobacco specific nitrosamine (TSNA) content. Preferably, the tobacco is ground to produce a powder for incorporation in the oral tobacco product.

While the foregoing has been described in detail with reference to specific embodiments thereof, it will be apparent to one skilled in the art that various changes and modifications may be made, and equivalents thereof employed, without departing from the scope of the claims.

I claim:

1. A pouched, oral tobacco product, comprising:

a porous membrane comprising an outer wrapper and an inner liner in the form of a pouch; and an inner filling material enclosed within the porous membrane, the inner filling material comprising:

loose, fibrous tobacco having a particle size of greater than about 60 mesh; and tobacco beads comprising a majority amount of tobacco fines of waste tobacco having a particle size of less than about 60 mesh, the tobacco fines being dispersed uniformly throughout the entirety of each tobacco bead, wherein the tobacco beads have a moisture content of about 0.5% to about 25%;

the tobacco beads are substantially spheroidal tobacco beads included in the pouched, oral tobacco product in an amount of about 10% to about 95% by weight based on the weight of the pouched, oral tobacco product; and the inner filling material is essentially free of loose particles having a particle size of less than about 60 mesh.

2. The pouched, oral tobacco product of claim 1, wherein the substantially spheroidal tobacco beads include the tobacco fines in an amount of about 5 wt % to about 100 wt %.

3. The pouched, oral tobacco product of claim 1, wherein the substantially spheroidal tobacco beads include non-tobacco flavorants.

4. The pouched, oral tobacco product of claim 3, wherein the substantially spheroidal tobacco beads are in the condition of having been extruded and spheronized.

5. The pouched, oral tobacco product of claim 1, wherein the substantially spheroidal tobacco beads each have a diameter of about 0.1 mm to about 2.5 mm.

6. The pouched, oral tobacco product of claim 1, wherein the substantially spheroidal tobacco beads further include a binder.

7. The pouched, oral tobacco product of claim 6, wherein the binder is sugar beet fiber.

8. The pouched, oral tobacco product of claim 1, wherein each of the substantially spheroidal tobacco beads includes a coating.

9. The pouched, oral tobacco product of claim 8, wherein the coating is a time release coating.

10. The pouched, oral tobacco product of claim 8, wherein the coating includes at least one flavorant selected from the group consisting of lavender, cinnamon, cardamom, *apium graveolens*, fenugreek, cascarilla, sandalwood, bergamot, geranium, honey essence, rose oil, vanilla, lemon oil, orange oil, mint oils, *cassia*, caraway, cognac, jasmine, chamomile, menthol, *cassia*, ylang-ylang, sage, spearmint, ginger, coriander, coffee, combinations thereof, and combinations thereof.

11. The pouched, oral tobacco product of claim 10, wherein the at least one flavorant is included in each of the substantially spheroidal tobacco beads in an amount of about 0.1% to about 10% by weight of the weight of each of the substantially spheroidal tobacco beads.

12. The pouched, oral tobacco product of claim 1, wherein the liner includes at least one flavorant selected from the group consisting of lavender, cinnamon, cardamom, *apium graveolens*, fenugreek, cascarilla, sandalwood, bergamot, geranium, honey essence, rose oil, vanilla, lemon oil, orange oil, mint oils, *cassia*, caraway, cognac, jasmine, chamomile, menthol, *cassia*, ylang-ylang, sage, spearmint, ginger, coriander, coffee and combinations thereof.

13. The pouched, oral tobacco product of claim 12, wherein the at least one flavorant is included in the liner in an amount of about 0.1% to about 10% by weight of the weight of the liner.

14. The pouched, oral tobacco product of claim 1, wherein the pouched, oral tobacco product has a maximum length of less than about two inches and a maximum thickness of less than about two inches.

15. The pouched, oral tobacco product of claim 1, wherein the liner is made of a material selected from the group consisting of cellulosic materials, gums, polymers, starches, proteins, food grade materials, such as polysaccharide, protein films, porous papers and fabrics, synthetic polymers, and combinations thereof.

16. The pouched, oral tobacco product of claim 1, wherein the inner liner is a dissolvable film between the outer wrapper and the inner filling material.

17. The pouched, oral tobacco product of claim 16, wherein the inner liner is configured to reduce transfer of moisture from the inner filling material to the porous membrane.

18. The pouched, oral tobacco product of claim 16, wherein the inner liner is configured to reduce staining of the porous membrane.

19. The pouched, oral tobacco product of claim 1, wherein the substantially spheroidal tobacco beads have a moisture content of about 10% to about 15%.

20. A pouched, oral tobacco product having improved product appearance, comprising:

a porous membrane comprising an outer wrapper and an inner liner in the form of a pouch; and an inner filling material enclosed within the porous membrane, the inner filling material comprising:

loose, fibrous tobacco having a particle size of greater than about 40 mesh; and substantially spheroidal tobacco beads comprising a majority amount of tobacco fines of waste tobacco having a particle size of less than about 40 mesh, the tobacco fines being dispersed uniformly throughout the entirety of each tobacco bead, wherein the substantially spheroidal tobacco beads have a moisture content of about 0.5% to about 25%, the substantially spheroidal tobacco beads included in the pouched, oral tobacco product in an amount of about 10% to about 95% by weight based on the weight of the pouched, oral tobacco product;

the liner is dissolvable in saliva and/or water; and the inner filling material is essentially free of particles fines having a particle size of less than about 40 mesh.

* * * * *